US006773275B1

(12) United States Patent
Chen

(10) Patent No.: US 6,773,275 B1
(45) Date of Patent: Aug. 10, 2004

(54) CONNECTOR WITH STATIC ELECTRICITY DRAINING MECHANISM

(75) Inventor: Wen-Zheng Chen, Taipei (TW)

(73) Assignee: KYE Systems Corp. (TW)

( * ) Notice: Subject to any disclaimer, the term of this patent is extended or adjusted under 35 U.S.C. 154(b) by 0 days.

(21) Appl. No.: 10/642,456

(22) Filed: Aug. 15, 2003

(51) Int. Cl.[7] ..... H01R 13/648
(52) U.S. Cl. ..... 439/92; 439/947
(58) Field of Search ..... 439/92, 95, 96, 439/101, 108, 939, 947

(56) References Cited

U.S. PATENT DOCUMENTS 5,725,394 A * 3/1998 Banakis et al. ..... 439/108
6,227,879 B1 * 5/2001 Dong ..... 439/92
6,227,880 B1 * 5/2001 Zhu et al. ..... 439/92

* cited by examiner

*Primary Examiner*—Renee Luebke
(74) *Attorney, Agent, or Firm*—Raymond Sun

(57) ABSTRACT

A memory card connector is positioned on a printed circuit board (PCB) which is coupled to ground so as to receive and couple a memory card. The connector has a main body positioned on the PCB. The connector also has a cover removably attached to the main body to define a memory card receiving space between the PCB, the main body and the cover. The cover has at least one flexible extension extending into the receiving space, and a draining portion that is electrically coupled to the main body. The memory card is inserted into the receiving space so that the extension contacts a metal portion on the memory card, with the extension electrically coupled to ground via the draining portion and the main body. Thus, static electricity can be drained to ground via the extension, the draining portion and the main body.

15 Claims, 3 Drawing Sheets

CONNECTOR WITH STATIC ELECTRICITY DRAINING MECHANISM

BACKGROUND OF THE INVENTION

1. Field of the Invention

The present invention relates to a connector, and in particular, to a connector utilizing a static electricity draining mechanism to protect a memory card from being damaged by static electricity.

2. Description of the Prior Art

A Compact Flash (CF) card is one of the most popular flash memory cards, and has been used in personal digital assistants (PDA), printers, and digital cameras, among others. The compact and precise design of a CF card enables it to reach 1024 MB in memory capacity and to be read by a CF card reader. Each CF card reader is typically tested under the strike of static electricity at thousands of volts, which is called an "Electrostatic Discharge (ESD) Test", so as to comply with the regulations of the European Committee or other countries.

A published patent (Taiwanese Application No. 529795) entitled "Connector for Electronic Card" discloses a similar design to drain the static electricity caused by the human body, where a leading unit is attached to an isolated connector body. The leading unit has a grounding portion electrically connected with the ground of a PCB (printed circuit board), and a contact portion that penetrates into an insert portion of the connector. When a memory card fits into the insert portion of the connector, the contact portion will appropriately touch a metal plate of the memory card such that the static electricity will be drained to the ground of the PCB. The primary defect of this design is that it has an extremely complex structure for draining the static electricity to the ground. In addition, the complex design of the leading unit means that the connector is also provided with a complex structure. Thus, the cost of producing the connector is inevitably high. Furthermore, the leading unit has to be installed separately, which makes it more difficult and inconvenient to assemble the entire structure of the connector.

SUMMARY OF THE DISCLOSURE

It is an object of the present invention to provide a connector that can effectively avoid damage by static electricity.

It is another object of the present invention to provide a connector that has a simple and inexpensive static electricity draining mechanism.

In order to accomplish the objects of the present invention, the present invention provides a memory card connector that is positioned on a printed circuit board (PCB) which is coupled to ground so as to receive and couple a memory card. The connector has a main body positioned on the PCB. The connector also has a cover removably attached to the main body to define a memory card receiving space between the PCB, the main body and the cover. The cover has at least one flexible extension extending into the receiving space, and a draining portion that is electrically coupled to the main body. The memory card is inserted into the receiving space so that the extension contacts a metal portion on the memory card, with the extension electrically coupled to ground via the draining portion and the main body. Thus, static electricity can be drained to ground via the extension, the draining portion and the main body.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
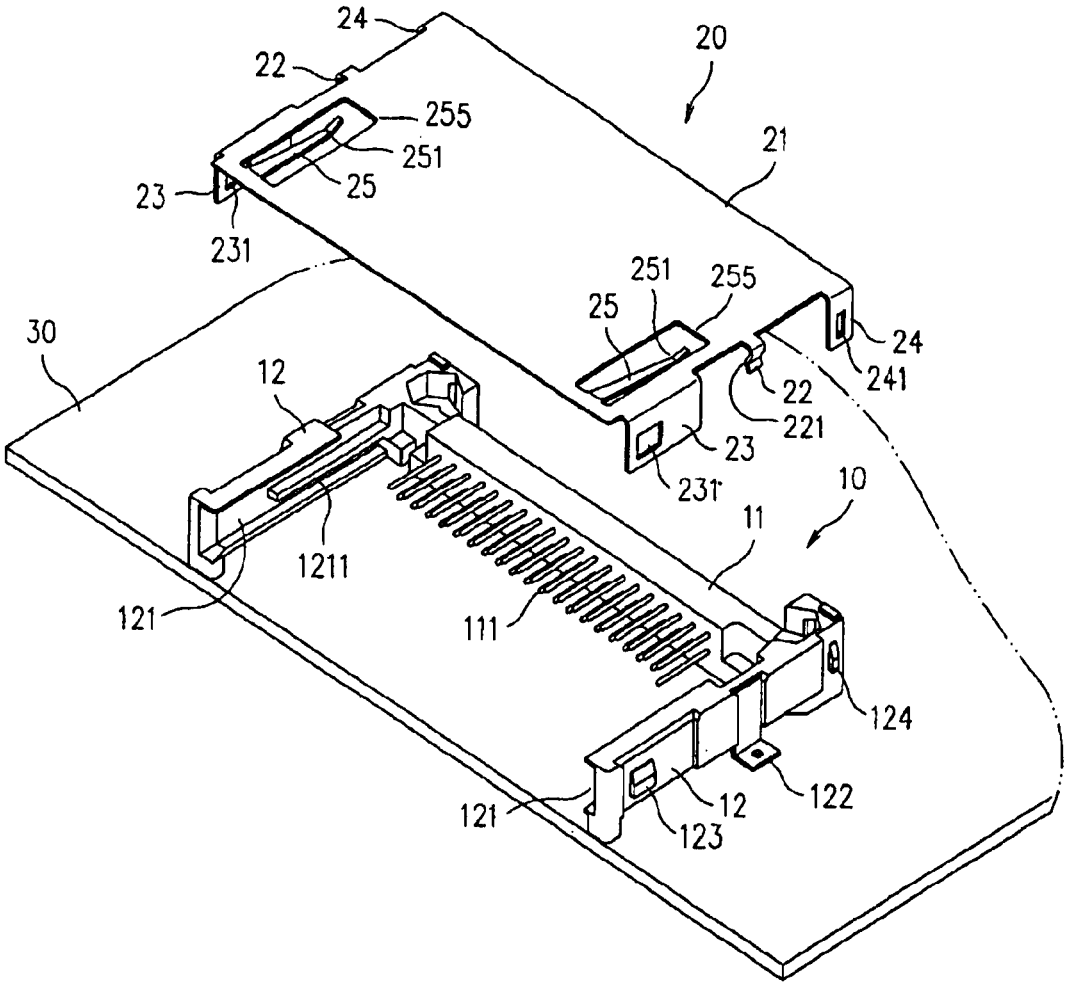
FIG. 1 is an exploded perspective view of one embodiment of a connector according to the present invention.
Figure 2:
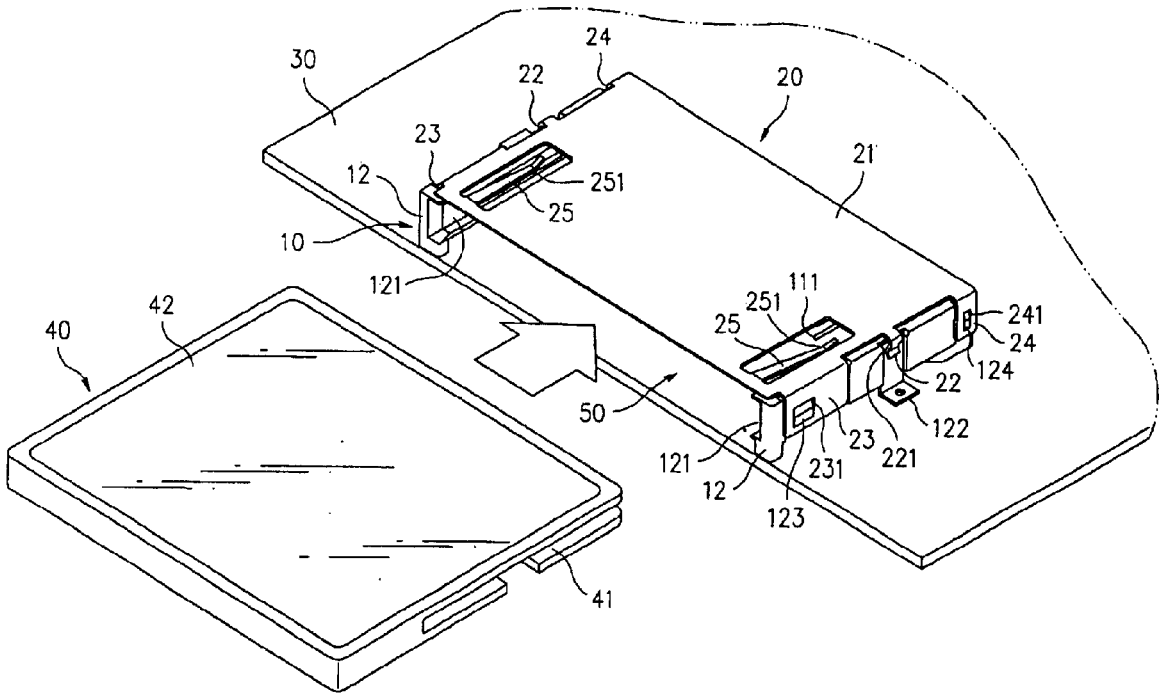
FIG. 2 is an exploded perspective view of the connector of FIG. 1 shown in use with a CF memory card.

Referring to FIGS. 1 and 2, the connector according the present invention has a main body 10 and a metal cover 20 that is attached to the main body 10.

The main body 10 has a terminal base 11 and an arm 12 that extends from each end of the base 11 so as to form a U-shaped structure for receiving a CF memory card. The terminal base 11 has a plurality of terminals 111, and the inner portion of each of the arms 12 has a groove 121. A rib 1211 is positioned inside each groove 121. The terminals 111, the grooves 121 and the ribs 1211 are configured and arranged to receive a standard CF memory card 40. Each rib 1211 is adapted to be inserted into a corresponding recess 41 of the memory card 40. The outer portion of each arm 12 has two hooks 123, 124. An L-shaped conducting piece 122 is positioned between the hooks 123, 124 and extends perpendicularly from each arm 12. Each conducting piece 122 can be welded to the ground (not shown) of a printed circuit board (PCB) 30 electrically.

A metal cover 20 has a body 21 which can be embodied in the form of a generally flat horizontal plate. Two cut-outs 255 are provided in the body 21, with one cut-out 255 adjacent each side edge of the body 21. A flexible extension 25 extends downwardly in each cut-out 255. Each extension 25 has a bent front portion 251. In one embodiment, each extension 25 can be formed integrally in one piece with the rest of the body 21 using a pressing process. A draining portion 22 extends integrally (i.e., in one piece) from each side edge of the body 21 in a position that is aligned with each conducting piece 122. Each draining portion 22 has an arc portion 221 that provides a bias to the draining portion 22 so that the draining portion 22 can be biased to engage the corresponding conducting piece 122 so as to allow the cover 20 to lockingly engage the main body 10 at the conducting piece 122. A pair of vertical fixing plates 23 and 24 extend from each side edge of the body 21. An opening 231 and 241 is provided in each fixing plate 23 and 24, respectively, and is aligned with the corresponding hooks 123 and 124 along each arm 12. Thus, when the cover 20 is assembled to the main body 10, each hook 123 and 124 will be retained inside each respective opening 231 and 241 of the respective fixing plates 23 and 24. As a result, the cover 20, the main body 10 and the PCB 30 define an receiving space into which a memory card 40 can be inserted.

Figure 3:
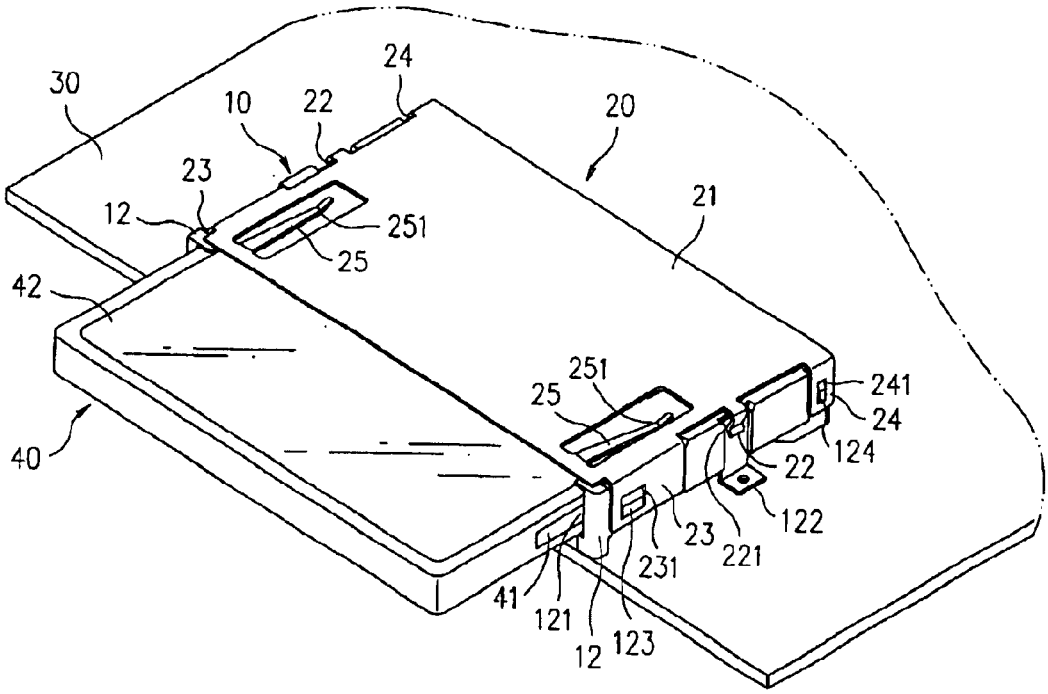
FIG. 3 is a perspective view of the connector of FIG. 1 shown with a CF memory card inserted therein.

As shown in FIGS. 1–3, when a memory card 40 is inserted into the receiving space 50, the terminals 111 will fit into corresponding holes (not shown) at the front end of the memory card 40, and the front portion 251 of each extension 25 will contact a metal portion 42 of the card 40, thereby electrically connecting the metal portion 42, the extension 25, the draining portion 22 and the ground of the PCB 30 so that the static electricity caused by user's body will be drained to the ground of the PCB 30, so as not to damage the data stored in the memory card 40.

The connector of the present invention can be utilized with any computer or electronic device that includes a card reader, including but not limited to personal computers (PCs), laptops, personal digital assistants (PDAs), and others.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A memory card connector assembly, comprising:

a printed circuit board having a ground connection;

a main body positioned on the circuit board, the main body having a conducting piece that is coupled to the circuit board, a terminal base, and one arm that extends from the terminal base, with the conducting piece positioned on the arm;

a cover removably attached to the main body to define a memory card receiving space between the circuit board, the main body and the cover, the cover having at least one flexible extension extending into the receiving space, the cover further having a draining portion that is electrically coupled to the main body, with the extension and draining portion formed in one piece with the cover; and a memory card having a metal portion, the memory card inserted into the receiving space so that the extension contacts the metal portion, with the extension electrically coupled to the ground connection of the circuit board via the draining portion.

2. The assembly of claim 1, wherein the cover has two side edges, with the draining portion positioned adjacent one side edge and aligned with the conducting piece.

3. The assembly of claim 1, further including means for removably attaching the cover to the main body.

4. The assembly of claim 1, further including means positioned on the arm for removably attaching the cover to the main body.

5. The assembly of claim 1, wherein the cover is made of metal.

6. The assembly of claim 1, wherein the extension has a bent front portion.

7. A memory card connector assembly, comprising:

a printed circuit hoard having a ground connection;

a main body positioned on the circuit board and having a conducting piece;

a cover removably attached to the main body to define A memory card receiving space between the circuit board, the main body and the cover, the cover having at least one flexible extension extending into the receiving space, the cover further having a draining portion that is electrically coupled to the main body, with the extension and draining portion formed in one piece with the cover; and a memory card having a metal portion, the memory card inserted into the receiving space so that the extension contacts the metal portion, with the extension electrically coupled to the ground connection of the circuit board via the draining portion;

wherein the draining portion has means for biasing the draining portion to engage the conducting piece.

8. A memory card connector that is positioned on a printed circuit board which is coupled to ground so as to receive and couple a memory card, the connector comprising:

a main body having a conducting piece, a terminal base, and one arm that extends from the terminal base, with the conducting piece positioned on the arm; and a cover removably attached to the main body to define a memory card receiving space between a circuit board, the main body and the cover, the cover having at least one flexible extension extending into the receiving space, the cover further having a draining portion that is electrically coupled to the main body.

9. The connector of claim 8, further including a memory card having a metal portion, the memory card inserted into the receiving space so that the extension contacts the metal portion, with the extension electrically coupled to ground via the draining portion and the conducting piece.

10. The connector of claim 8, wherein the cover has two side edges, with the draining portion positioned adjacent one side edge and aligned with the conducting piece.

11. The connector of claim 8, further including means for removably attaching the cover to the main body.

12. The connector of claim 8, further including means positioned on the arm for removably attaching the cover to the main body.

13. The connector of claim 8, wherein the cover is made of metal.

14. The connector of claim 8, wherein the extension has a bent front portion.

15. A memory card connector that is positioned on a printed circuit board which is coupled to ground so as to receive and couple a memory card, the connector comprising:

a main body; and a cover removably attached to the main body to define a memory card receiving space between a circuit board, the main body and the cover, the cover having at least one flexible extension extending into the receiving space, the cover further having a draining portion that is electrically coupled to the main body;

wherein the draining portion has means for biasing the draining portion to engage the main body.

* * * * *